US006820369B2

(12) United States Patent
Fenelon

(10) Patent No.: US 6,820,369 B2
(45) Date of Patent: Nov. 23, 2004

(54) WINDOW LIFT MECHANISM

(76) Inventor: Paul J. Fenelon, 13 Inverary, Nashville, TN (US) 37215

( * ) Notice: Subject to any disclaimer, the term of this patent is extended or adjusted under 35 U.S.C. 154(b) by 3 days.

(21) Appl. No.: 10/124,943

(22) Filed: Apr. 18, 2002

(65) Prior Publication Data

US 2003/0196383 A1 Oct. 23, 2003

(51) Int. Cl.[7] ..... E05F 15/08

(52) U.S. Cl. ..... 49/349; 49/358; 49/362; 464/93

(58) Field of Search ..... 49/348, 349, 362, 49/358, 502; 469/73, 92, 93

(56) References Cited

U.S. PATENT DOCUMENTS

| | | | | |
|---|---|---|---|---|
| 548,695 | A | 10/1895 | Capron | |
| 1,356,123 | A | 10/1920 | Belle | |
| 1,480,453 | A | 1/1924 | Lane | |
| 1,487,926 | A | 3/1924 | Evans | |
| 1,683,914 | A | 9/1928 | Pfiffer | |
| 1,850,091 | A | 3/1932 | Bailey | |
| 1,939,159 | A | 12/1933 | Atwood | |
| 2,115,632 | A | 4/1938 | Hanley | |
| 2,291,275 | A | 7/1942 | Ackerman | |
| 2,293,968 | A | 8/1942 | Chandler | |
| 2,319,088 | A | 5/1943 | Roethel | |
| 2,336,530 | A | * 12/1943 | Chandler et al. | 49/362 |
| 2,345,594 | A | 4/1944 | Gerdner | |
| 2,531,116 | A | 11/1950 | Donoghue | |
| 2,883,780 | A | 4/1959 | Goodman | |

(List continued on next page.)

FOREIGN PATENT DOCUMENTS

| | | |
|---|---|---|
| DE | 1931471 | 12/1970 |
| DE | 2217784 | 10/1973 |
| DE | 2544174 A1 | 4/1977 |
| DE | 2841440 A1 | 4/1980 |
| DE | 3243123 A1 | 5/1984 |
| DE | 3545856 C1 | 1/1987 |
| DE | 4005759 A1 | 8/1991 |
| DE | 29613322 U1 | 10/1996 |
| FR | 1425449 | 4/1966 |
| FR | 2111220 | 6/1972 |
| FR | 2550267 A1 | 2/1985 |
| FR | 2650647 A1 | 2/1991 |
| GB | 851436 | 10/1960 |
| JP | 5-86761 | 4/1993 |
| WO | WO96/41087 | 6/1995 |
| WO | WO97/37099 | 10/1997 |

OTHER PUBLICATIONS

Ford 1973 Car Shopt Manual, vol. 4, Body Ford Marketing Corporation, Ford Customer Service Division, Service Technical Communications Dept., Dearborn, MI (printed Sep. 1972).

*Primary Examiner*—Jerry Redman
(74) *Attorney, Agent, or Firm*—Harness, Dickey & Pierce, P.L.C.

(57) ABSTRACT

A window lift mechanism for raising and lowering a window in a vehicle door includes a support bracket mounted to the window and a motor supported on the support bracket, wherein the support bracket permits the axial and rotational movement of the window relative to the support bracket. A pair of parallel, vertical racks are mounted to the door and are positioned immediately adjacent to the window. A worm gear is driven by a worm with a lead angle greater than seven degrees coupled to a motor. A clutch mechanism is utilized to prevent back drive of the worm/worm gear system. The worm gear is operatively coupled to a pinion gear with resilient shock absorbers that are provided with notched surfaces to accommodate for compression of the resilient material with an enclosed space.

14 Claims, 11 Drawing Sheets

U.S. PATENT DOCUMENTS 3,659,466 A 5/1972 Pickles
3,662,568 A 5/1972 Kashima et al.
3,706,163 A 12/1972 Pickles
3,706,236 A 12/1972 Pickles
3,736,702 A 6/1973 Pickles
4,082,008 A 4/1978 Kluting
4,119,341 A 10/1978 Cook
4,167,834 A 9/1979 Pickles
4,168,595 A 9/1979 Pickles et al.
4,170,847 A 10/1979 Pickles
4,182,078 A 1/1980 Bartholomew
4,229,906 A 10/1980 Pickles
4,235,117 A 11/1980 Pickles
4,328,451 A 5/1982 Barge
4,389,818 A 6/1983 Sakamoto
4,400,913 A 8/1983 Krantz et al.
4,420,906 A 12/1983 Pickles
4,534,233 A * 8/1985 Hamaguchi ..... 74/89.2
4,553,656 A 11/1985 Lense
4,592,245 A 6/1986 Pickles
4,603,894 A 8/1986 Osenkowski
4,698,938 A 10/1987 Huber
4,770,055 A * 9/1988 Chevance et al. ..... 74/411
4,785,585 A 11/1988 Grier et al.
4,850,636 A 7/1989 McLaren et al.
4,878,396 A 11/1989 Grunberg
4,910,917 A 3/1990 Brauer
4,967,510 A * 11/1990 Torii et al. ..... 493/358
4,970,827 A 11/1990 Djordjevic
5,000,055 A 3/1991 Kim
5,005,316 A 4/1991 Hornivius
5,022,184 A 6/1991 Yamamura et al.
5,174,066 A 12/1992 Dupuy
5,226,259 A 7/1993 Yamagata et al.
5,251,403 A 10/1993 Compeau et al.
5,307,704 A 5/1994 Muller
5,308,129 A 5/1994 Hlavaty
5,308,138 A 5/1994 Hlavaty
5,309,677 A 5/1994 Kunert et al.
5,351,443 A 10/1994 Kimura
5,355,629 A 10/1994 Kimura
5,367,832 A 11/1994 Compeau et al.
5,410,921 A 5/1995 Deynet et al.
5,425,206 A 6/1995 Compeau et al.
5,577,347 A 11/1996 Heckel et al.
5,806,244 A * 9/1998 Tilli ..... 49/358
5,836,205 A 11/1998 Meyer
5,928,083 A * 7/1999 Monahan et al. ..... 464/57
5,943,913 A 8/1999 Fenelon
6,073,395 A * 6/2000 Fenelon ..... 49/358
6,145,252 A * 11/2000 Fenelon ..... 49/349
6,216,394 B1 * 4/2001 Fenelon ..... 49/349
6,389,753 B1 * 5/2002 Fenelon ..... 49/348
6,430,874 B1 * 8/2002 Korte ..... 49/358

* cited by examiner

WINDOW LIFT MECHANISM

FIELD OF THE INVENTION

The present invention relates generally to an apparatus for moving a window into an open or closed position. In particular, the present invention relates to a mechanism for use with an automobile window, wherein the mechanism utilizes pinion gears with resilient shock absorbers to cushion the system from disturbances, a clutch mechanism to prevent back-drive of the worm gear and a support bracket that allows the window to find the path of least resistance during closure.

BACKGROUND OF THE INVENTION

Modern automobiles typically include a window lift assembly for raising and lowering windows in the door of the vehicle. A common type of window lift assembly incorporates a "scissor mechanism." A scissor-type system utilizes a series of linkages in a scissor configuration such that as the bottom linkages move apart, the top linkages do as well, resulting in a scissor-like motion. The window is fastened to a bracket connected to a linkage. A motor and gearset drives the scissor mechanism in power operated window mechanisms.

The scissor-type mechanism is typically mechanically inefficient, prohibiting the use of light-weight materials and requiring the use of relatively large motors to drive the system. The large motors necessarily require increased space and electrical power and also increase the weight of the system. With the limited space in a scissor-type system it is also necessary, in order to provide the required torque transfer efficiency and acceptable up and down times (3–4 seconds), to have a small diameter pinion gear, typically 0.5 to 0.75 inches, and relatively large worm gear, typically 1.8 to 2.5 inches in diameter, with gear ratios of 9 to 16 and 80 to 90, respectively. This results in excessive worm gear speed in the range of 3000 to 4000 RPM which causes excessive worm gear tooth shock and armature noise. The combination of high torque, typically 80 to 125 inch-pounds at stall, and shock due to high worm speeds mandates that either expensive multiple gears and/or single worm gears with integral shock absorbers be utilized.

Further, the scissor-type mechanism does not take into account the manufacturing deviations in the door, specifically with the window frame and mounting points, and deviations in the manufacture of the scissor-type mechanism. Deviations in the door and scissor-type mechanism result in larger than necessary forces being applied to the window when it cycles up and down. The larger force on the window causes undesirable noise in the passenger cabin.

Accordingly, a need exists for a window lift mechanism with increased efficiency that would allow for a reduction in the motor size and hence the mass of the system, and a support structure for the window that permits the window to find the path of least resistance when it cycles up and down.

SUMMARY OF THE INVENTION

The present invention provides a window lift mechanism for an automobile window. The window lift mechanism of the present invention has a gear set with at least one pinion gear and at least one worm gear operatively coupled together and supported by the window. The gear set is driven by a motor with an output shaft having a worm which engages the worm gear. The window lift mechanism utilizes a clutch mechanism to increase the efficiency of the torque transfer from the motor to the worm gear in the gear set. The clutch mechanism includes a pair of springs located within the worm gear. This clutch mechanism prevents back drive, hence allowing for the worm on the output shaft of the motor to have a lead angle greater than seven degrees. With a larger worm angle, the amount of torque transferred from the worm to the worm gear is increased, allowing for a smaller motor. The smaller motor reduces the mass of the system.

Further, the gear set in the window lift mechanism of the present invention has a resilient shock absorber operatively engaged between the pinion gear and the worm gear. The shock absorber has surfaces with notched portions to allow for deformation of the resilient shock absorber, which reduces unwanted stress in the gear set and thereby increases the life of the gears.

The window lift mechanism of the present invention has two support structures, the first support is coupled to the closure member and the second support is coupled to the first support. The second support houses a portion of the gear set. There is an interface between the first and second supports which permits axial and rotational movement of the window with respect to the second support. Specifically, the first support has a forked side coupled to the window and a slot for receipt of a protrusion from the second support. The allowed movement of the window allows the closure member to find the path of least resistance during closure, and aids in overcoming manufacturing imperfections.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
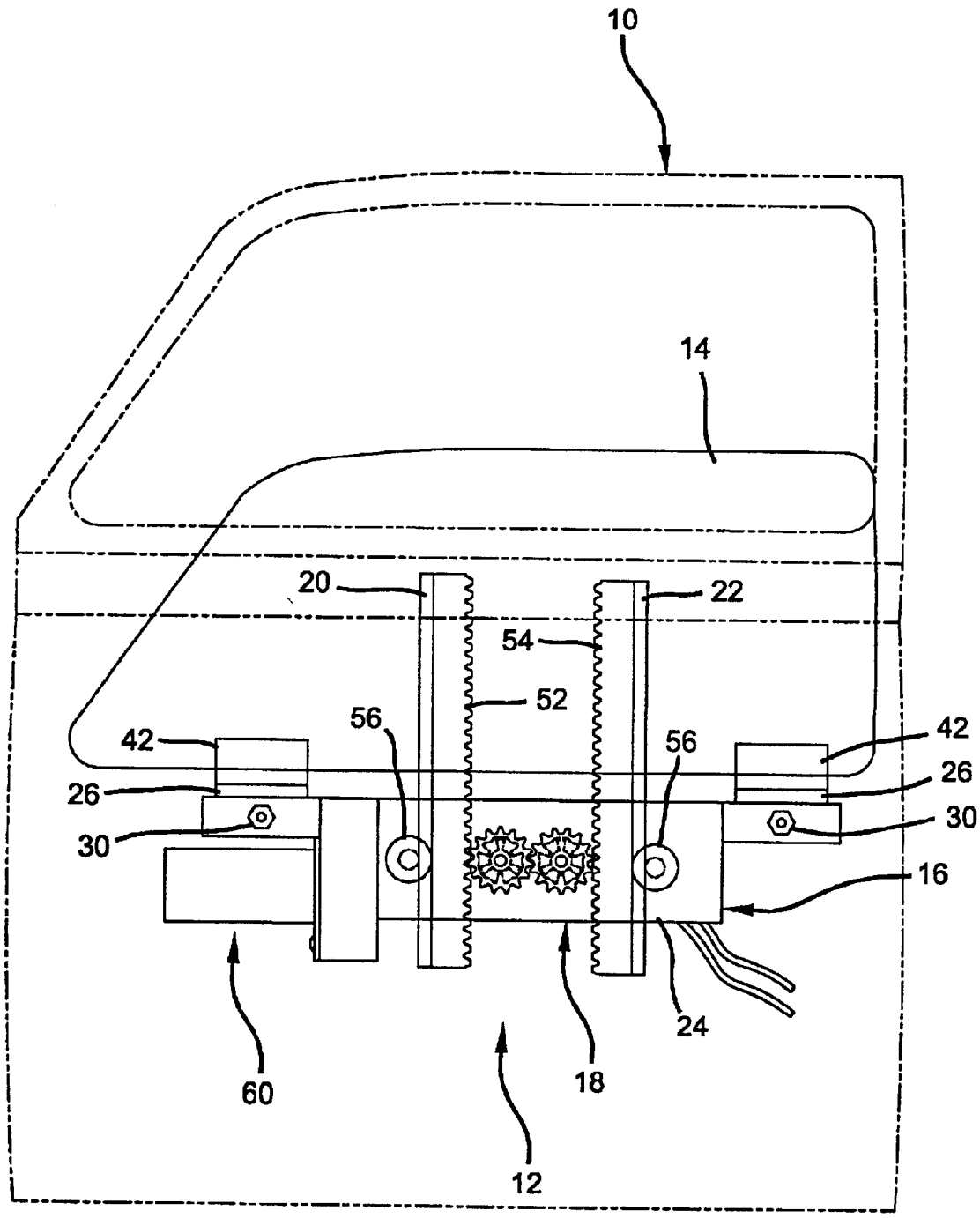
FIG. 1 is a front view of a window lift mechanism for an automobile door according to the principles of the present invention.

Referring generally to FIG. 1, a vehicle door 10 is shown including a window lift mechanism 12. A window 14 is supported by the window lift mechanism 12 and is located within the automobile door 10. The window lift mechanism 12 includes a support structure 16 and a drive system 18. The drive system 18 is supported by the support structure 16 and serves to drive the support structure 16 relative to a pair of racks 20, 22 which are securely mounted to the door 10.

The support structure 16 includes a main bracket 24. A pair of guide brackets 26 (best shown in FIGS. 4–6) are mounted to the main bracket 24 by a fastener 28 and a nut 30. The guide brackets 26 include a body portion 32 including an elongated vertical slot 34 for receiving the fastener 28. A pair of opposing stop flanges 36 extend from opposite sides of the body portion 32. An elongated semi-cylindrical guide portion 38 is disposed on an upper neck portion 40 of the guide bracket 26. The support structure 16 further includes a pair of window brackets 42 which are slidably engaged with the guide brackets 26.

Figure 4A:
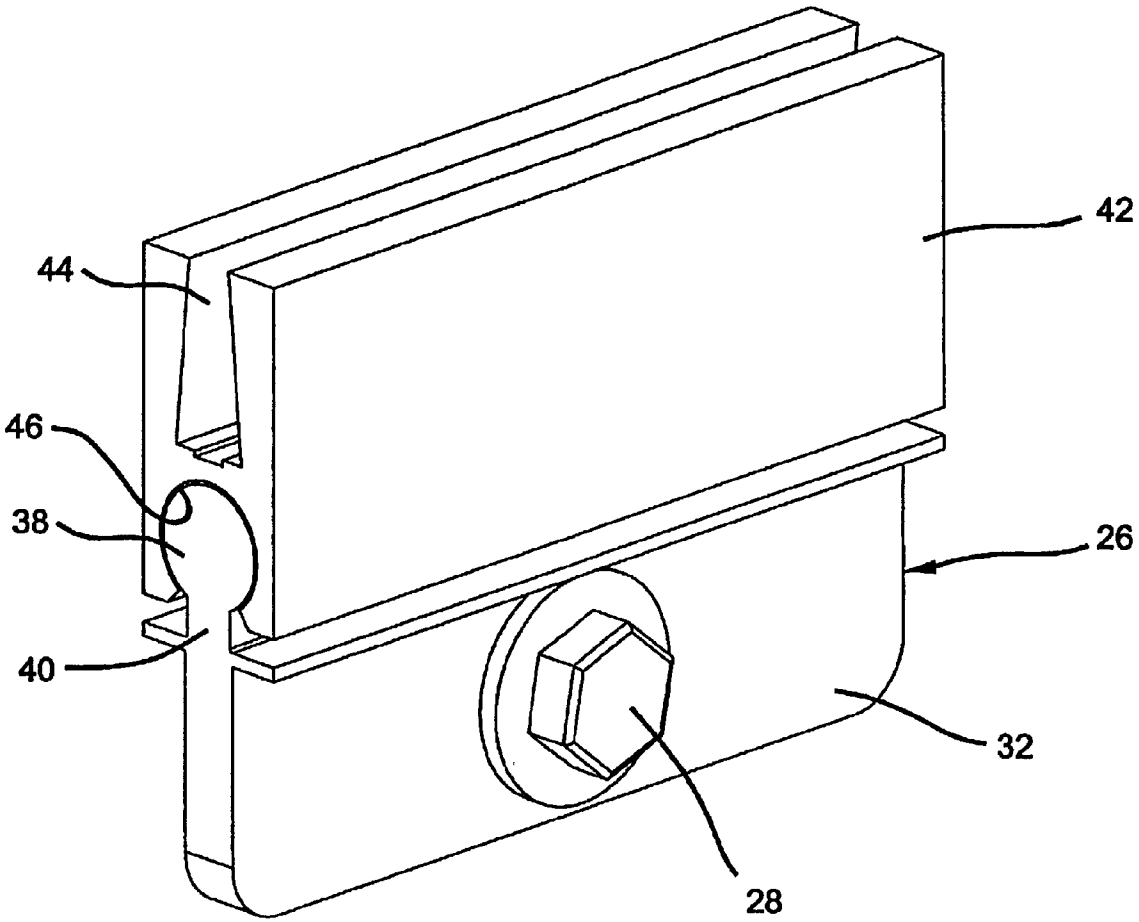
FIG. 4*a* is a perspective view of a support structure for the window lift mechanism according to the principles of the present invention.
Figure 4B:
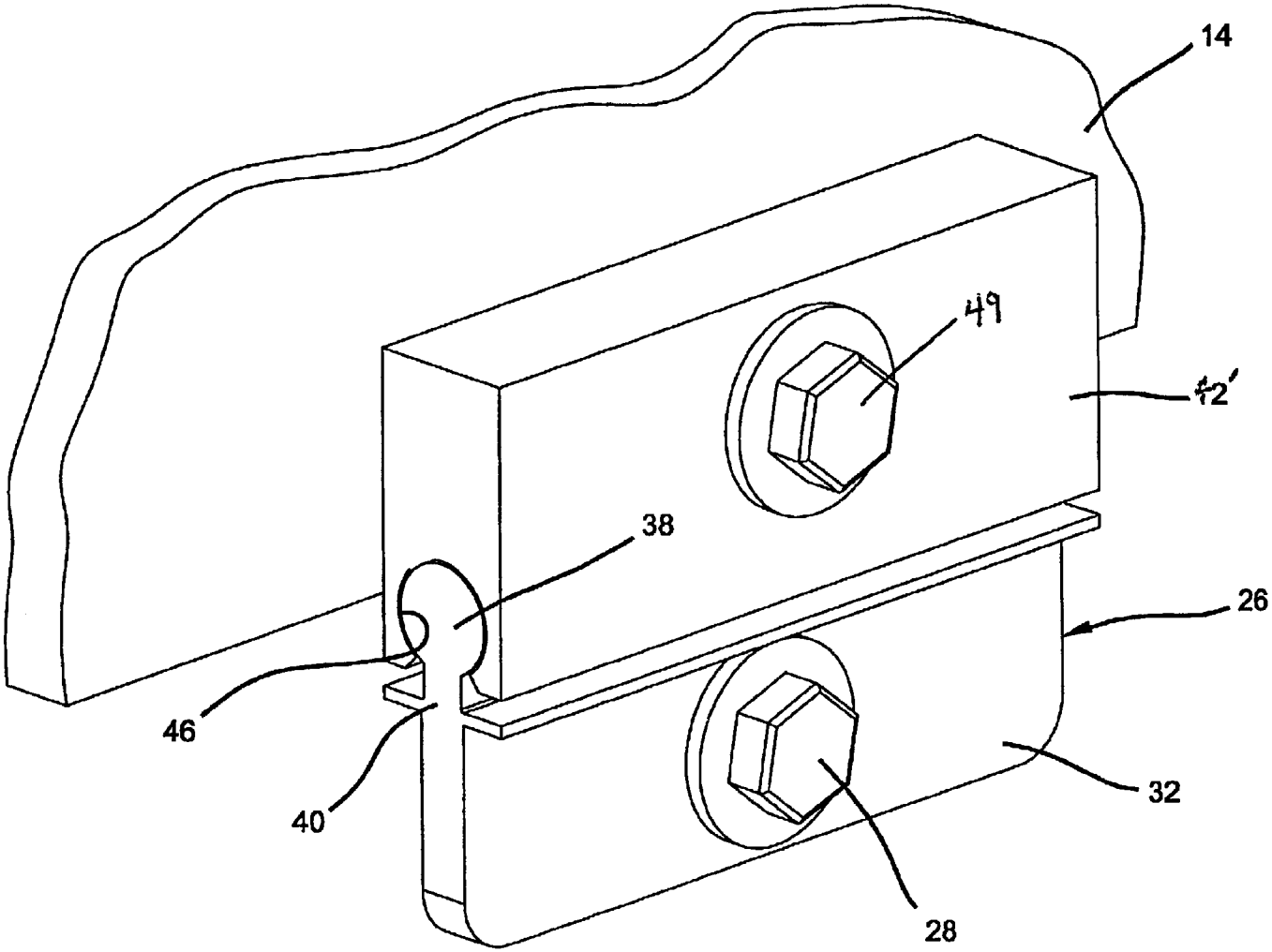
FIG. 4*b* is a perspective view of an alternative support structure for the window lift mechanism according to the principles of the present invention.
Figure 5:
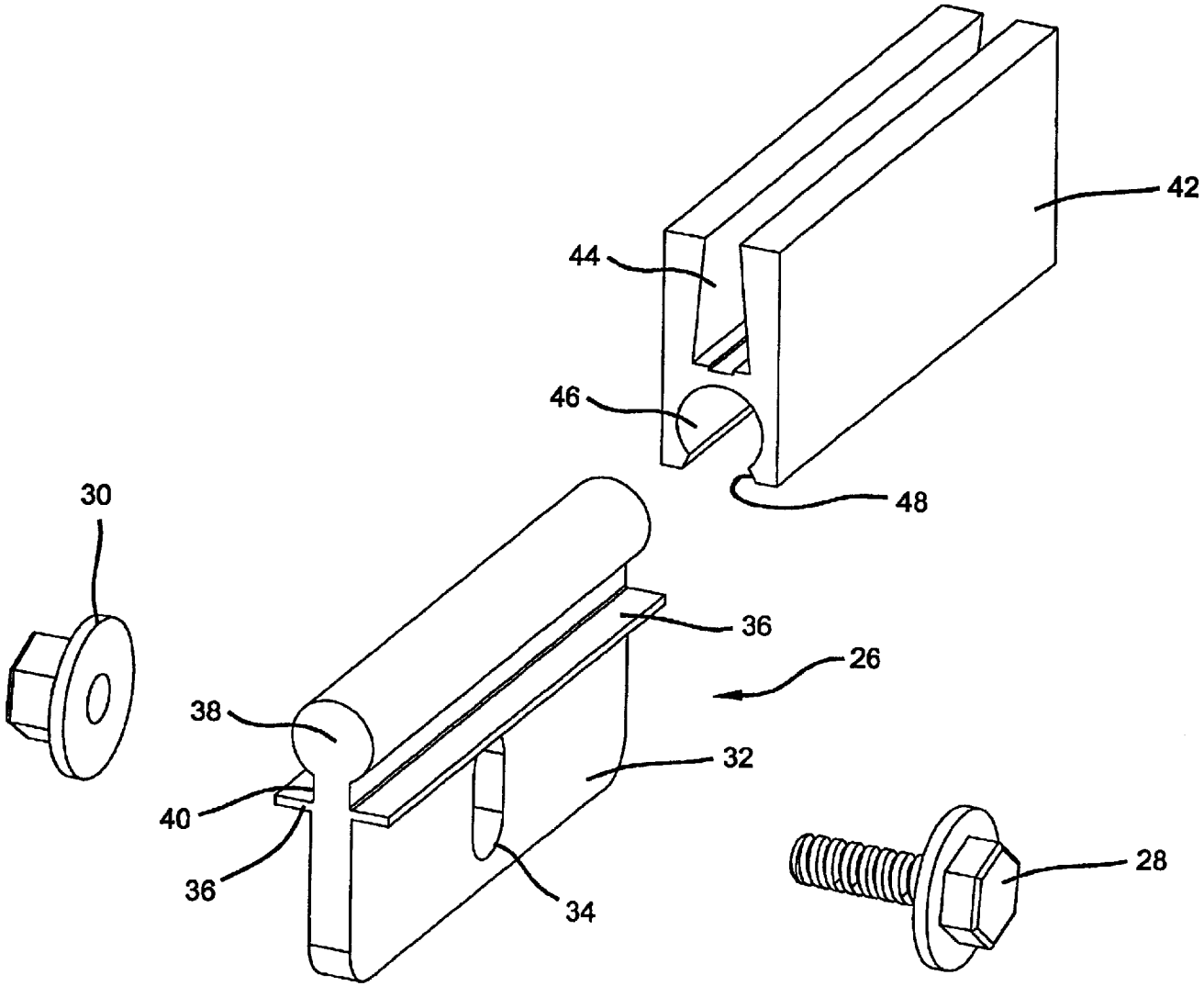
FIG. 5 is an exploded perspective view of the support structure according to the principles of the present invention.
Figure 6:
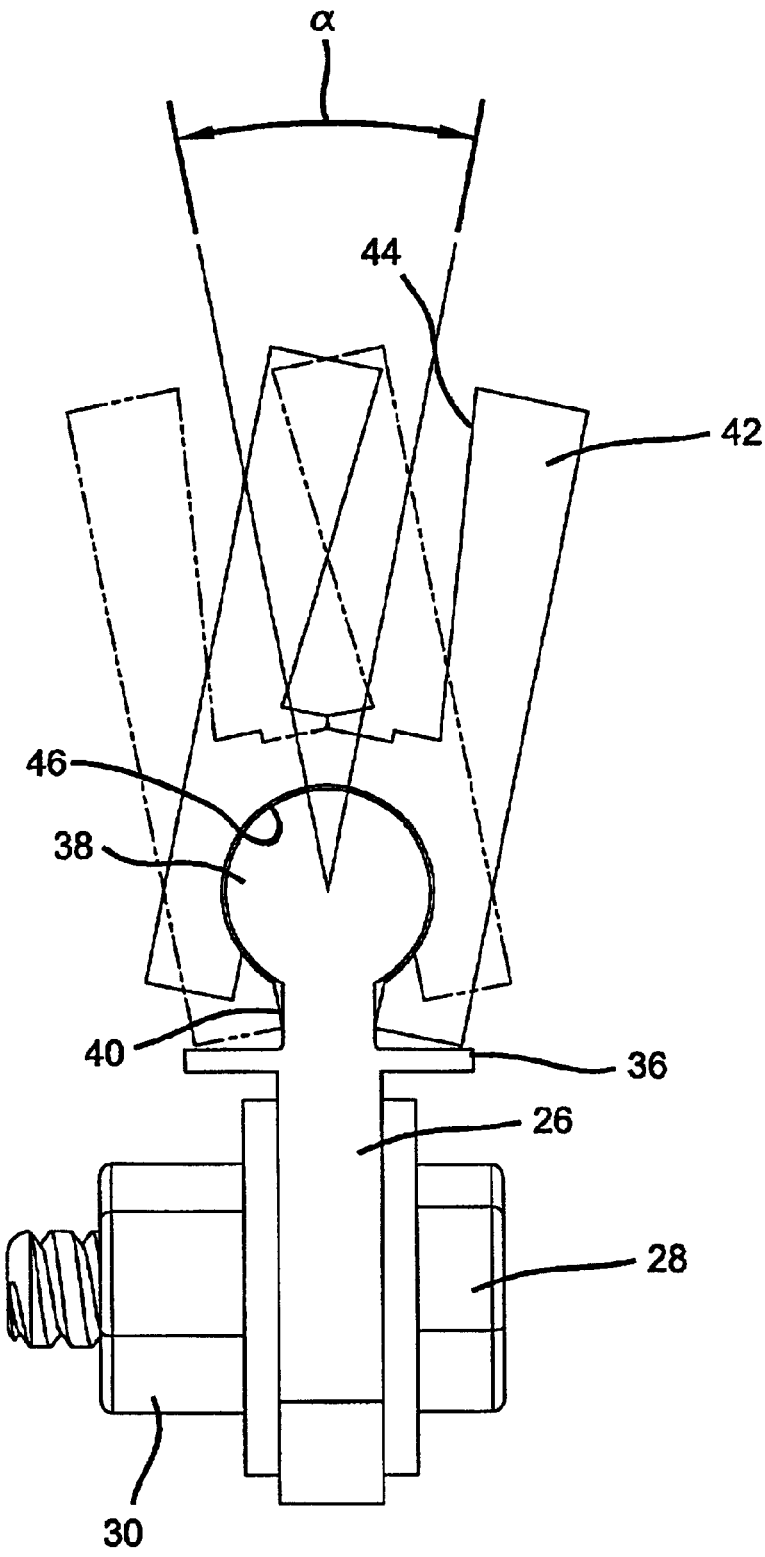
FIG. 6 is an end view of the support structure of FIG. 4 illustrating the range of motion of the upper support bracket.

The window brackets 42 have a window channel 44 for receipt of the window 14 and a guide channel 46 having a semi-cylindrical inner surface for receiving the semi-cylindrical guide portion 38 of the guide bracket 26, as best shown in FIG. 4*a*. The guide channel 46 has an opening end portion 48 having a diameter greater than a width of the upper neck portion 40 of the guide bracket 26 so as to allow angular movement of the window bracket 42 relative to the guide bracket 26, as illustrated in FIG. 6. In FIG. 6, the window bracket 42 is shown tilted in a first forward position, as illustrated in solid lines, and is shown in a rearward tilted position, as illustrated in phantom 42'. The window bracket 42 is able to pivot angularly by a predetermined angular amount $\propto$(up to approximately 25°, preferably at least 20°), as well as sliding axially relative thereto in order to accommodate for variances in the door, support structure, and drive system. The interface between the opening 48 and upper neck portion 40, therefore provides the support structure 16 with two degrees of freedom with regard to the axial and rotational adjustment achieved by the guide bracket 26 and window bracket 42. By enabling the window bracket 42 to move with two degrees of freedom relative to the guide bracket 26, the window 14 is allowed to find the path of least resistance during opening and closing. In particular, the two degrees of freedom aids in overcoming unwanted imperfections in the door 10, window 14, support structure 16, and drive system 18. The movement of the window bracket 42 relative to the guide bracket 26 reduces the force placed on the drive system 18 and window 14, as well as reducing the noise generated by the window 14 and drive system 18. As shown in FIG. 4*b*, the window bracket 42' can also be mounted to the window 14 by a fastener 49.

Figure 2:
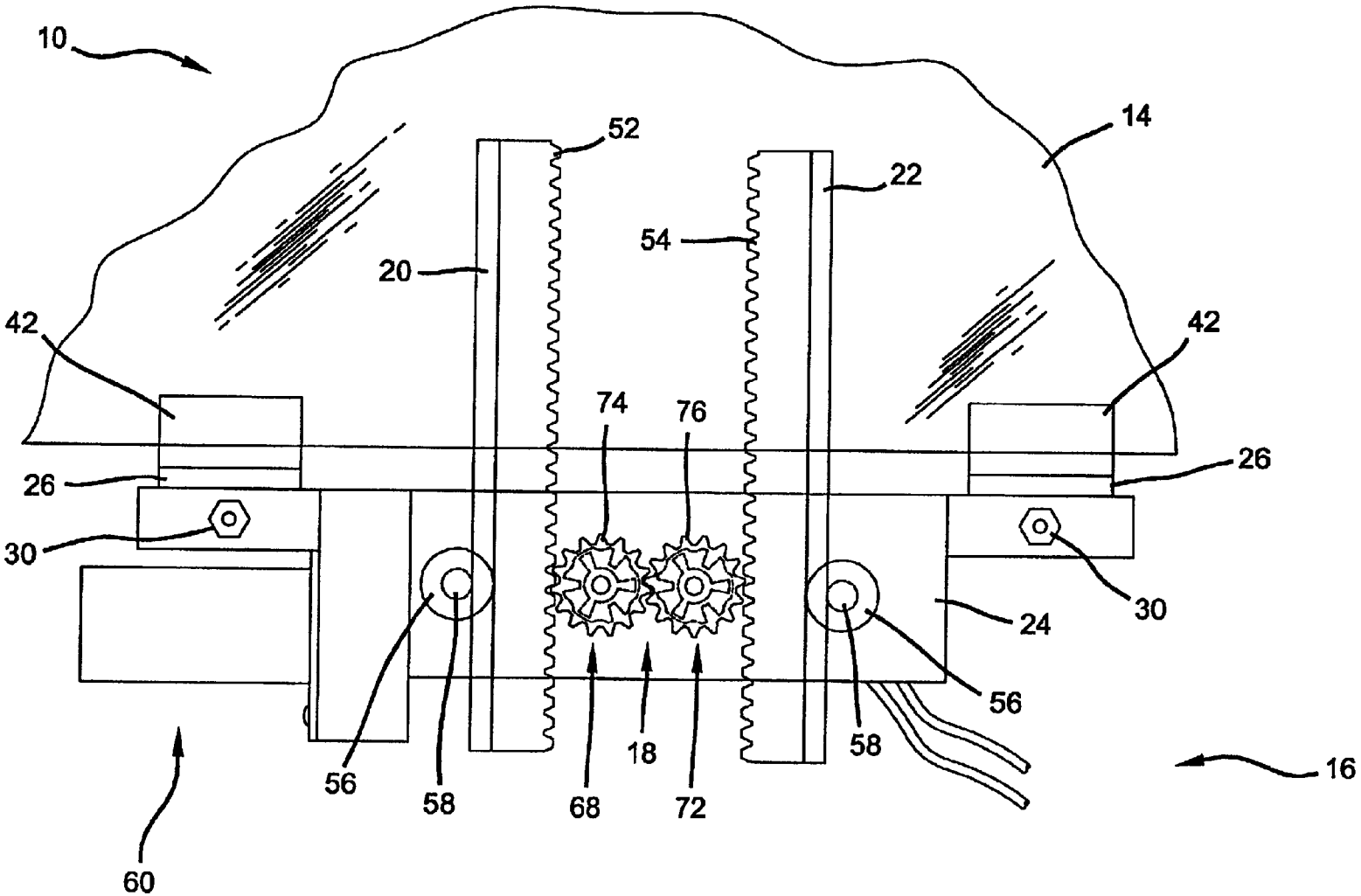
FIG. 2 is a detailed front view of the window lift mechanism according to the principles of the present invention.

Referring to FIG. 2, the main bracket 24 interacts with the racks 20, 22. The first rack 20 includes a row of teeth 52 which faces a row of teeth 54 on the second rack 22. Teeth 52 and 54 are in engagement with drive system 18 for raising and lowering the window 14. Guide members 56 are provided on the main bracket 24, adjacent to the first and second racks 20 and 22. Guide members 56 keep the first and second racks 20 and 22 in engagement with the drive system 18. Guide members 56 are generally plastic spool shaped members with a cylindrical body extending perpendicularly from the main bracket 24 and a circular flange extending radially from the distal end of the cylindrical body. The guide members 56 are rotatably supported by a pair of cylindrical posts 58 (shown in phantom in FIG. 2) extending perpendicularly from the main bracket 24.

Figure 3:
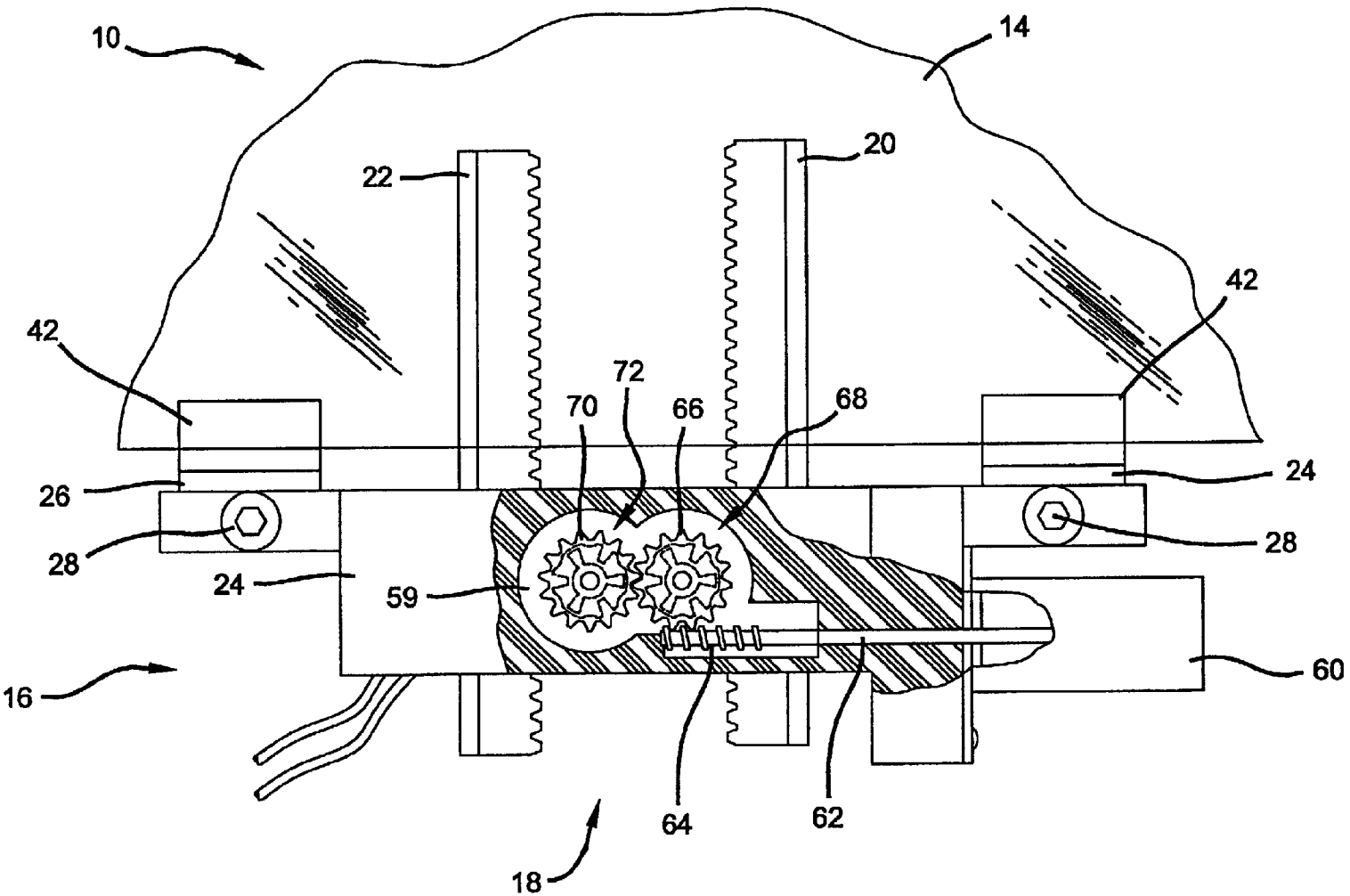
FIG. 3 is a rear, partially cut-away view of the window lift mechanism according to the principles of the present invention.

Referring generally to FIGS. 2 and 3, the main bracket 24 of the support structure 16 supports and houses a portion of the drive system 18 within an internal compartment 59. The drive system 18 includes a motor 60 which is mounted to the main bracket 24. As best shown in FIG. 3, the motor 60 includes a driveshaft 62 which is provided with a worm 64 at an end thereof. Worm 64 drives a first worm gear 66 of a first worm gear/pinion assembly 68. The worm gear 66 is engaged with a second worm gear 70 of a second worm gear/pinion assembly 72. The first worm gear/pinion assembly 68 includes a pinion gear 74 which is drivingly engaged with the first worm gear 66 in a manner that will be described in greater detail herein. The first pinion gear 74 is engaged with the teeth 52 of the rack 20 and also engaged with a second pinion gear 76 of the second worm gear/pinion assembly 72. The second pinion gear 76 is engaged with teeth 54 of second rack 22. The second pinion gear 76 is drivingly engaged with the second worm gear 70 in a manner that will be described in greater detail herein.

In operation, the motor 60 drives the driveshaft 62 which drives the worm 64. The worm 64 drives the first worm gear 66 of the first worm gear/pinion assembly 68. The first worm gear 66 drives the second worm gear 70 of the second worm gear/pinion assembly 72. Upon rotation of the first and second worm gears 66, 70, the first and second pinion gears 74, 76 are driven and engaged with racks 20, 22 for causing the support structure 16 to move up and down relative to the racks 20, 22 for raising and lowering the window 14.

Figure 7:
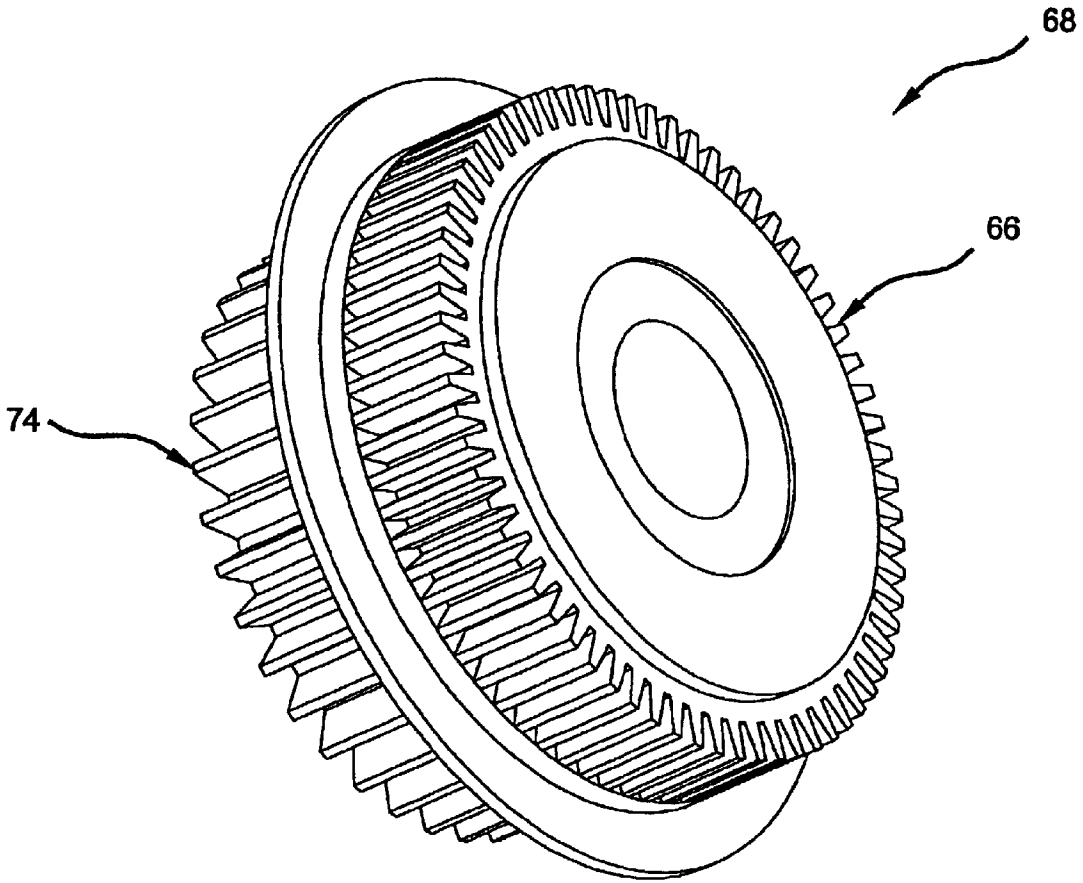
FIG. 7 is a perspective view of a worm gear/pinion assembly for use with the present invention.
Figure 8:
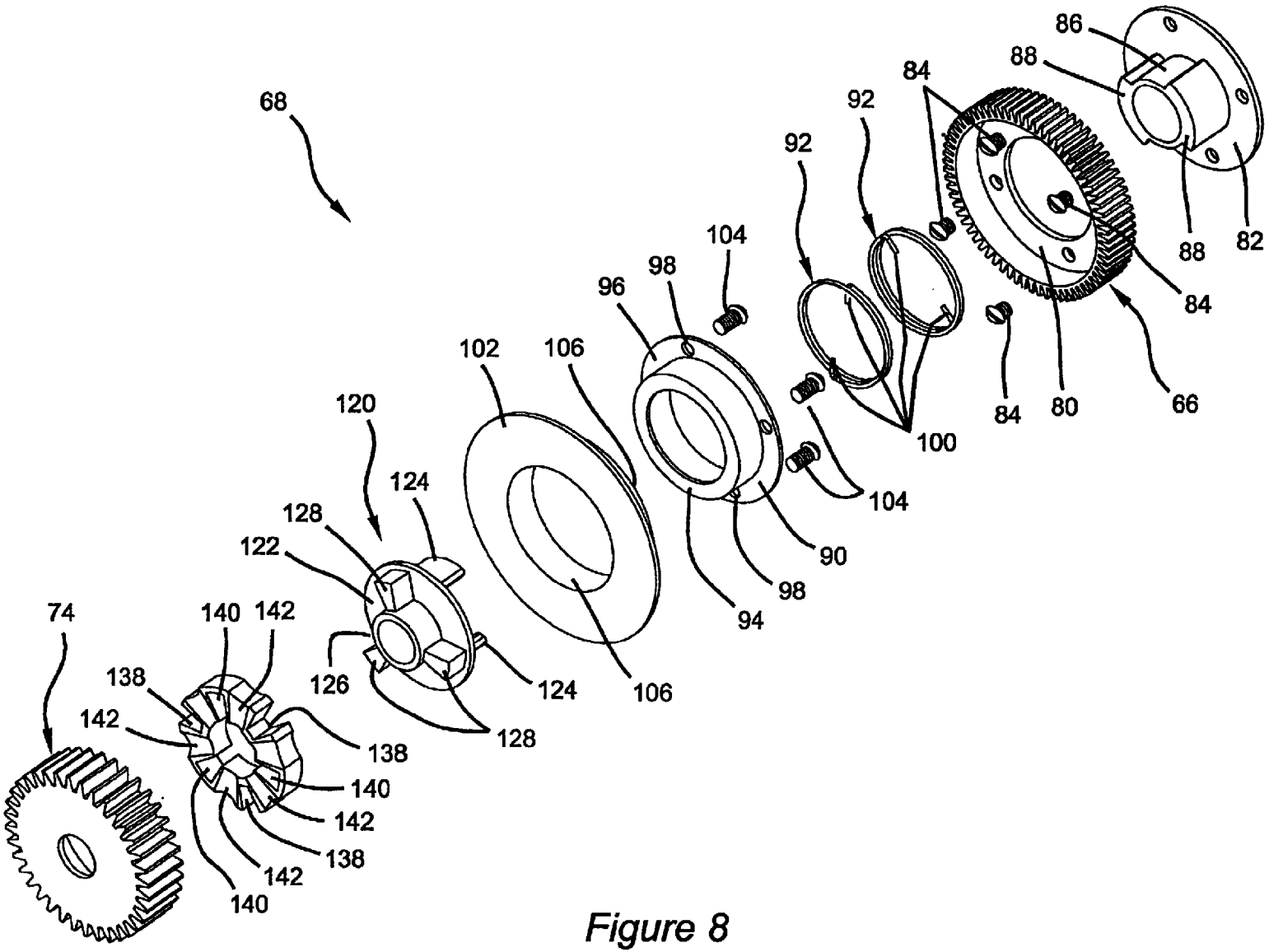
FIG. 8 is an exploded perspective view of the worm gear/pinion assembly of FIG. 7 according to the principles of the present invention.

Both the first and second worm gear/pinion assemblies 68, 72 are identical and, hence, only the first worm gear/pinion assembly 68 will be discussed in detail. With reference to FIGS. 7 and 8, the first worm gear/pinion assembly 68 includes the first worm gear 66 and the first pinion gear 74. The worm gear 66 includes an inwardly extending flange portion 80, best shown in FIG. 8. A worm gear hub portion 82 is attached to the flange portion 80 of worm gear 66 by a plurality of fasteners 84. The hub portion 82 includes a keyed shaft portion 86 including two semi-cylindrical protrusions 88 extending radially therefrom. The shaft portion 86 is received in a spring retainer 90 which includes a pair of clutch springs 92 within an angular body portion 94 thereof. A radially extending flange 96 extends from the annular body portion 94 and includes a plurality of apertures 98 therein.

The clutch springs 92 each include a helically wrapped spring wire having two end fingers 100 extending radially inward. The end fingers 100 of each clutch spring 92 are disposed opposite one another. The clutch springs 92 are received within the annular body portion 94 of the spring retainer 90 and are arranged at 90 degree offsets from one another in order to define four separate quadrants 110, 112, 114, 116 (best shown in FIG. 10) between the end fingers 100 of the two clutch springs 92. The spring retainer 90 is mounted to a clutch housing 102 by threaded fasteners 104 extending through apertures 98 in the flange 96 of the spring retainer 90. Threaded fasteners 104 engage threaded apertures (not shown) that are provided on the face of the clutch housing 102. The clutch housing 102 includes an axially extending hub portion 106 in which the annular body portion 94 of spring retainer 90 is received.

Figure 10:
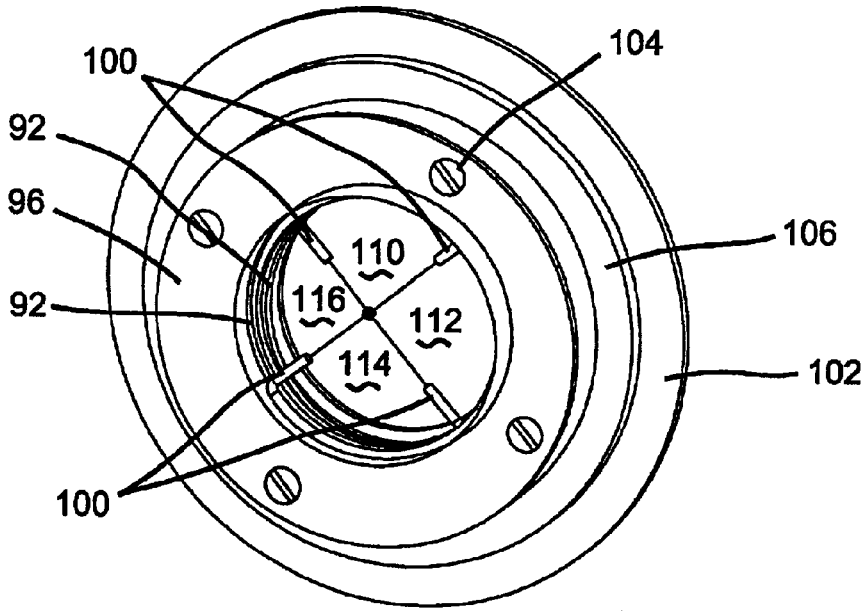
FIG. 10 is a perspective view of a clutch mechanism of the worm gear/pinion assembly.

With reference to FIG. 10, the clutch assembly is shown including the spring retainer 90 disposed within the clutch housing 102 and clutch springs 92 having end fingers 100 each extending radially inward and defining the four generally equally spaced quadrants 110, 112, 114, and 116. The axially extending shaft portion 86 of the worm gear hub portion 82 extend into the clutch housing 102 such that the radially extending semi-cylindrical protrusions 88 are each received within an opposing quadrant (for example, quadrants 110, 114). The clutch springs 92 are arranged such that when the motor is being driven, the clutch springs 92 rotate within the housing 102. However, when the motor is stationary, forces applied to the springs 92 by the drive train tend to cause the springs to expand and thereby prevent the springs from rotating.

Figure 9:
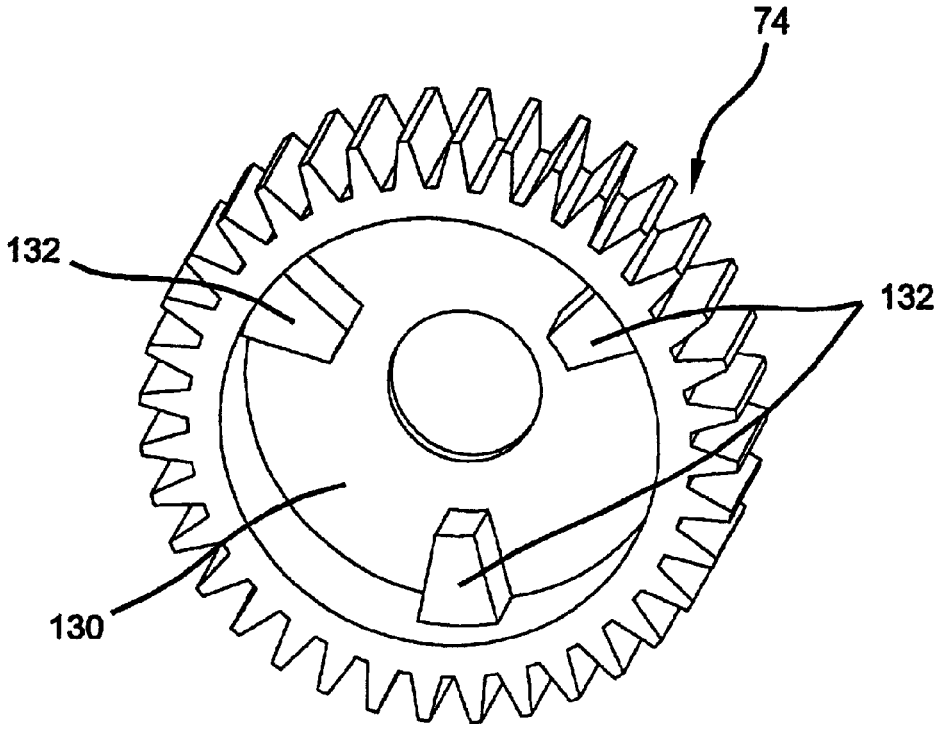
FIG. 9 is a front perspective view of a pinion gear of the worm gear/pinion assembly.

A shock absorber bridge 120 is provided with a disk shaped body portion 122 having a pair of axially extending semi-cylindrical fingers 124. The semi-cylindrical fingers 124 extend into the clutch housing 102 and are received in opposing quadrants 112, 116 defined by the end fingers 100 of clutch springs 92. The shock absorber bridge 120 also includes a cylindrical protrusion 126 extending from a second side of the disk shaped body 122 and includes three radially extending triangular protrusions 128 extending from the cylindrical protrusion 126. The cylindrical protrusion 126 and triangular protrusions 128 of shock absorber bridge 120 are received within an interior cavity 130 of pinion gear 74. As best shown in FIG. 9, pinion gear 74 includes radially inwardly extending protrusions 132 extending inwardly within the cavity 130. A resilient shock absorber 136 is disposed between the pinion gears 74 and the shock absorber bridge 120. The resilient shock absorber 136 is made from an elastomeric material such as santroprene 55. The resilient shock absorber 136 includes three triangular cutouts 138 extending radially inward from an outer surface thereof for receiving the radially inwardly extending protrusions 132 of the pinion gear 74. The resilient shock absorber 136 also includes three triangular cutouts 140 which extend radially from the inner surface of the resilient shock absorber 136 for receiving the radially outwardly extending protrusions 128 of the shock absorber bridge 120.

The resilient shock absorber 136 is pressed into the cavity 130 of the pinion gear 74 so that the inwardly extending protrusions 132 of the pinion gear 74 are received in the radially inwardly extending cutouts 138 of the resilient shock absorber 136. The cylindrical protrusion 126 and radially extending protrusions 128 are inserted in the central opening of the resilient shock absorber 136 and the radially extending cutouts 140, respectively. The resilient shock absorber 136 is provided with a plurality of body sections 142 which are each disposed between a radially inwardly extending cutout 138 and a radially outwardly extending cutout 140.

Figure 11A:
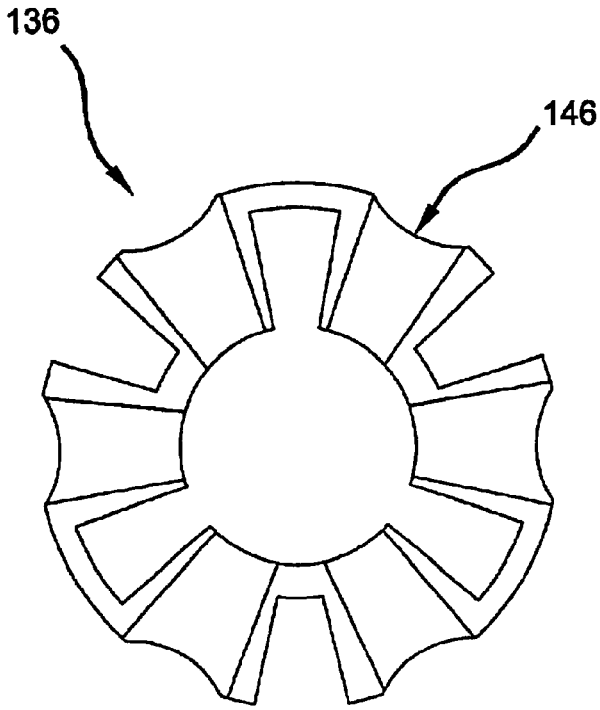
FIG. 11*a* is a front plan view of the resilient shock absorber according to the principles of the present invention.
Figure 11B:
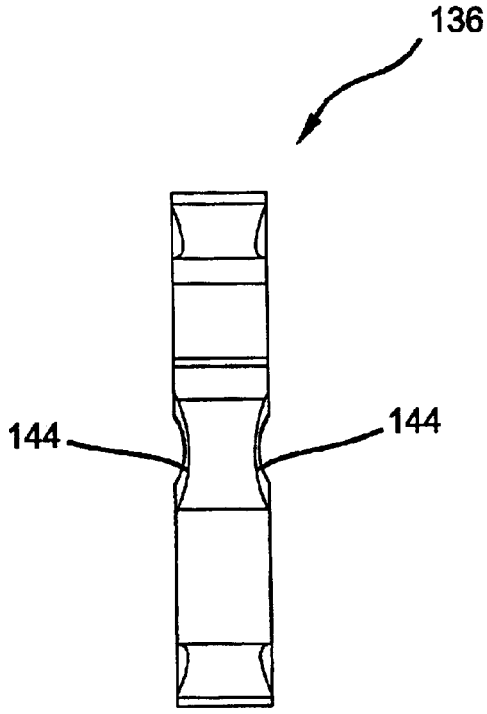
FIG. 11*b* is a side view of the resilient shock absorber of FIG. 11*a*.

Due to the limited space in the cavity 130, the side surfaces and radial surface of the body sections 142 are notched inwardly to accommodate for deformation. Specifically, elastomeric materials have a Poisson's ratio of approximately 0.5, and therefore, under compression and/or tension, the volume of the material is retained. Hence, inward deformation in one direction causes the material to bulge outward in other directions. Thus, compression of the resilient shock absorber 136 in the lateral direction will cause the elastomeric material to deform or bulge outward in the axial and radial directions. Thus, in order to accommodate for the bulging of the elastomeric material under compression, the notched surfaces 144, 146 allow room for deformed elastomeric material to move into. If the notches were not provided, non-optimum force deflection occurs since the efficiency of the resilient shock absorber 136 is directly related to the amount of deflection at any applied force. Thus, a preferred design is one which allows the volume to be maintained. As shown in FIGS. 11*a* and 11*b*, the notched side surfaces 144 are best shown in the side view of FIG. 11*b* and the notched radial surfaces 146 are best shown in plan view of FIG. 11*a*. Within the first worm gear/pinion assembly arrangement 68, the optimum design of the resilient shock absorber 136 is achieved by sculpting both the radially outward surface with notches 146 and each face with notches 144. This sculpting allows proper deflection of the resilient shock absorber 136 and thereby prevents unwanted stress on the worm gear/pinion assembly 68, which increases the life span of the assembly.

During operation, the motor 60 drives driveshaft 62 which in turn rotates the worm 64. The worm 64 has the internal shaft portion 86 of gear hub portion 82 fixedly attached thereto for rotation therewith. As the shaft portion 86 rotates, force is transmitted through clutch springs 92 via engagement of the end fingers 100 engaging with the radially extending semi-cylindrical protrusions 88. The end fingers 100 thereby transmit rotation to the shock absorber bridge 120 via axially extending fingers 124. The shock absorber bridge 120 then transmits rotation to the pinion gear 74 via the resilient shock absorber 136. The resilient shock absorber 136 absorbs forces that are applied through the drive system 18 in order to prevent damage to components of the drive system 18, the support structure 16, or window 14.

Worm 64 is helical and directly engages the teeth of the first worm gear 66. Since the first worm gear 66 is engaged with the second worm gear 70, it is not necessary for the worm 64 to contact the second worm gear 70, although such an arrangement could also be utilized. The lead angle of the worm 64, according to a preferred embodiment of the present invention, is greater than seven degrees. Typically, a worm lead angle in such a system is required to be less than or equal to seven degrees, as a necessity in order to prevent backdrive. However, in these systems, the efficiency of the torque transferred from the worm to the worm gear tends to be low due to the low lead angle of the worm. In systems with low efficiency, a larger motor is needed to create more torque to overcome the inefficiencies in the system. In the present invention, however, the clutch mechanism in the form of clutch springs 92 is provided in order to allow the lead angle of the worm 64 to be increased greater than seven degrees in order to improve the efficiency thereof while the clutch mechanism prevents system backdrive. By increasing the lead angle of the worm 64, the efficiency of the torque transferred from the worm 64 to the worm gear 66 is increased, hence allowing for the use of a smaller motor 60.

The system of the present invention provides an improved, more efficient window lift mechanism wherein variations in the door and lift mechanism are accommodated for by the two degrees of freedom allowed for by the guide bracket and window bracket interface. In addition, the clutch mechanism, which is housed within the interior space of the worm gear 66 allows for the lead angle of the worm gear 66 to be increased for improved efficiency while preventing undesirable back drive from occurring with the increased lead angle utilized on the worm. Finally, the improved resilient shock absorber 136 being provided with notched surfaces to allow for displacement of the resilient material when loaded under compression, also leads to a more efficient shock absorber. The worm gear/pinion assembly is also provided with a compact arrangement since the worm gear and pinion can be disposed side by a side with a majority of the clutch structure and shock absorber structure being maintained within the interior compartments defined by the worm gear 66 and pinion gear 74.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A window lift mechanism comprising:

a support structure;

a pinion gear supported by said support structure;

a worm gear supported for rotation by said support structure and operatively joined with said pinion gear;

a motor supported by said support structure and including an output shaft having a worm engaged with said worm gear; and a resilient shock absorber operatively engaged between said pinion gear and said worm gear, said resilient shock absorber includes a body portion having a central opening therethrough and a plurality of cutouts extending radially inward from an outer surface thereof and a plurality of cutouts extending radially outwardly from an inner surface thereof said plurality of cutouts define a plurality of body segments therebetween, said plurality of body segments and having an outer perimeter surface with radially inwardly notched portions to allow for deformation of said resilient shock absorber.

2. The window lift mechanism of claim 1 wherein said resilient shock absorber is made of elastomeric material.

3. The window lift mechanism of claim 1 wherein a shock absorber chamber is disposed between said worm gear and said pinion gear for the receipt of said resilient shock absorber.

4. The window lift mechanism of claim 1 wherein said pinion gear has a plurality of raised surfaces for retaining said resilient shock absorber.

5. The window lift mechanism of claim 1 further comprising an intermediate member drivingly engaged with said worm gear and said resilient shock absorber.

6. The window lift mechanism of claim 5 wherein said intermediate member has two interface sides, one of said interface sides has protrusions which connect to said worm gear, and the other of said interface sides has a plurality of raised surfaces to receive said resilient shock absorber.

7. The window lift mechanism of claim 1 wherein said pinion gear defines an interior chamber for receiving said resilient shock absorber therein.

8. The window lift mechanism of claim 1, further comprising a clutch mechanism disposed between said worm gear and said pinion gear.

9. The window lift mechanism of claim 8 wherein said clutch mechanism further includes at least one coil spring.

10. A window lift mechanism comprising:

a support structure;

a pinion gear supported by said support structure;

a first worm gear supported for rotation by said support structure and drivingly engaged with said pinion gear;

a motor supported by said closure member and including an output shafts a worm connected to said output shaft of said motor and engaged with said worm gear, said worm having a lead angle greater than seven degrees; and a clutch mechanism disposed between said worm gear and said pinion gear to prevent back-drive.

11. The window lift mechanism of claim 10 wherein said worm gear includes a first shaft portion which engages said clutch mechanism and said pinion gear includes a second shaft portion which engages said clutch mechanism.

12. The window lift mechanism of claim 11, wherein said second shaft portion is defined by an intermediate member drivingly attached to said pinion gear.

13. A window lift mechanism comprising:

a support structure;

a pinion gear supported by said support structure;

a worm gear supported for rotation by said support structure meshingly engaged with said pinion gear;

a motor supported by said support structure and including an output shaft;

a worm connected to said output shaft and engaged with said worm gear; and a clutch mechanism disposed between said worm gear and said pinion gear.

14. The window lift mechanism of claim 13, wherein said worm has a lead angle greater than seven degrees.

* * * * *